US005475954A

United States Patent [19]

Molinazzi

[11] Patent Number: 5,475,954

[45] Date of Patent: Dec. 19, 1995

[54] MODULAR SUPPORT ELEMENT ADAPTED TO FORM A SUPPORT FOR A TREAD OF A STAIRCASE

[76] Inventor: Roberto Molinazzi, Via Beniamino Gigli, 24, 40137 Bologna, Italy

[21] Appl. No.: 212,055

[22] Filed: Mar. 14, 1994

[30] Foreign Application Priority Data

Mar. 16, 1993 [IT] Italy ..... TO93A0174

[51] Int. Cl.[6] ..... E04F 11/035

[52] U.S. Cl. ..... 52/183; 52/187; 108/95; 182/228

[58] Field of Search ..... 52/183, 183, 187, 52/188, 190, 191; 108/93, 94, 95; 182/228

[56] References Cited

U.S. PATENT DOCUMENTS

| | | | |
|---|---|---|---|
| 1,336,433 | 4/1920 | Hudson | 108/93 |
| 3,099,336 | 7/1963 | Hawkins | 189/43 |
| 3,343,316 | 9/1967 | McIntire | 52/190 |
| 4,285,178 | 8/1981 | Holzkämpfer et al. | 52/187 |
| 4,296,577 | 10/1981 | Schuette | 52/187 |
| 4,516,367 | 5/1985 | Molinazzi | 52/182 |
| 4,557,085 | 12/1985 | Yamazaki | 52/182 |
| 4,619,084 | 10/1986 | Snitman | 52/182 |
| 4,798,030 | 1/1989 | Molinazzi | 182/228 X |
| 5,085,020 | 2/1992 | Yamazaki | 52/183 |
| 5,088,248 | 2/1992 | Manna | 52/187 |
| 5,134,820 | 8/1992 | Liu | 52/182 X |

FOREIGN PATENT DOCUMENTS

| | | | |
|---|---|---|---|
| 0060014 | 9/1982 | European Pat. Off. . | |
| 1443918 | 5/1966 | France . | |
| 2590632 | 5/1987 | France . | |
| 2249280 | 4/1974 | Germany | 52/187 |
| 2256555 | 5/1974 | Germany . | |
| 2710641 | 9/1977 | Germany . | |
| 2623523 | 12/1977 | Germany | 52/182 |
| 2703273 | 3/1978 | Germany | 52/263 |
| 3446066 | 6/1986 | Germany | 52/187 |
| 3100257 | 4/1991 | Japan | 52/182 |
| 27526 | 6/1909 | Sweden | 52/187 |

*Primary Examiner*—Carl D. Friedman
*Assistant Examiner*—Laura A. Saladino
*Attorney, Agent, or Firm*—Ladas & Parry

[57] ABSTRACT

A support for treads of a staircase is formed by a plurality of support elements each comprising an upper plate and a lower plate, the lower and upper plates of each element being adapted to rest on the upper and lower plates respectively of contiguous elements. Adjustment and fixing members enable the upper plate to be moved relative to the lower plate of each element and be fixed together. The upper plate of each element is formed with at least one pair of holes, and at least one pair of female threads is fixed to the plate, each thread being coaxial with one of the holes. The lower plate of each element is formed with a through-hole and through-slot into which are inserted two screw members, each of which also passes through one of the holes in the upper plate of the contiguous element and is screwed into the corresponding female thread in the contiguous element so as to fix these two elements together.

16 Claims, 5 Drawing Sheets

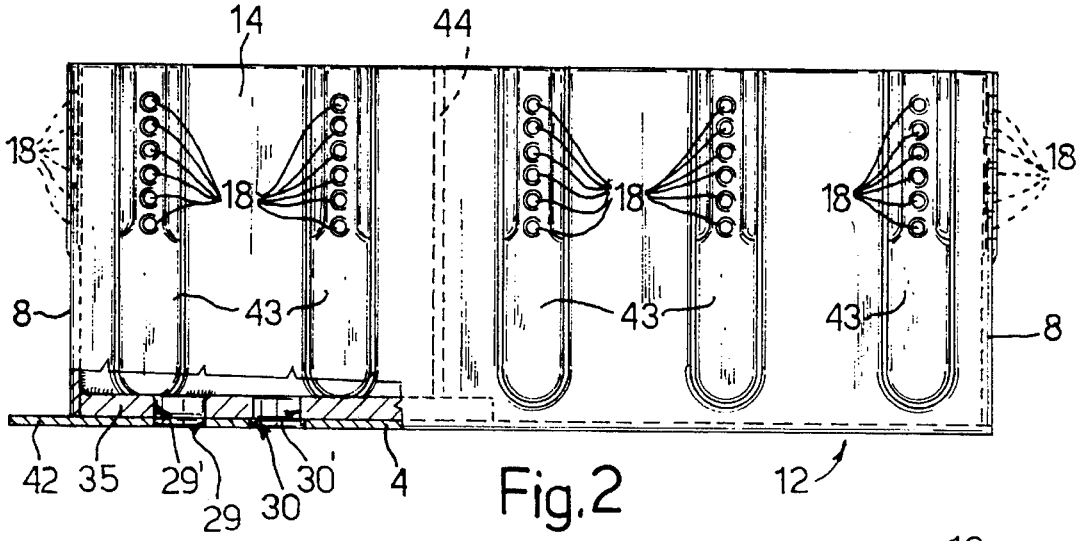
Fig.2
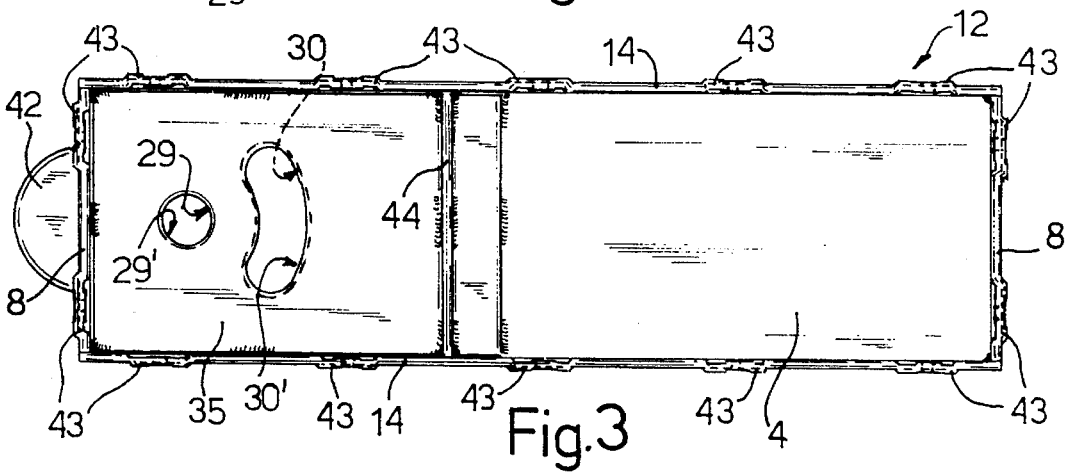
Fig.3
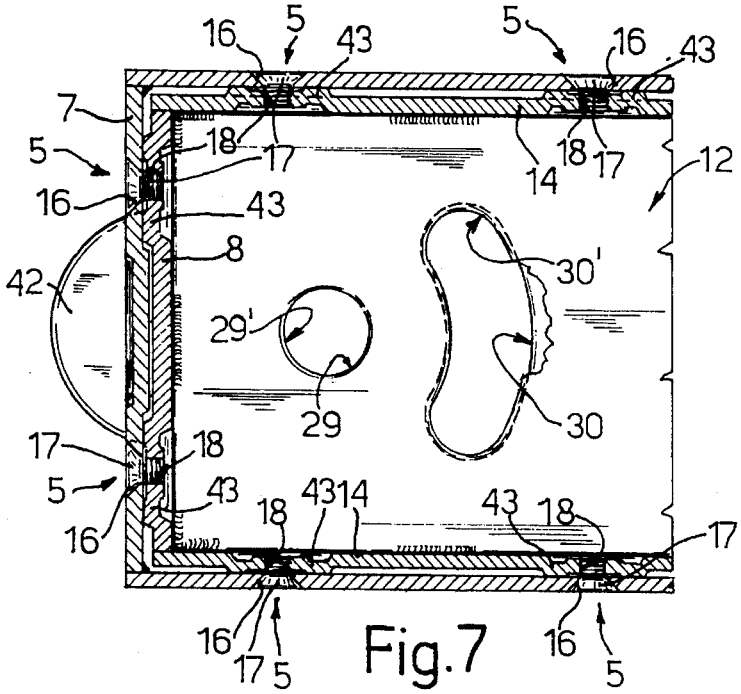
Fig.7
Fig.10
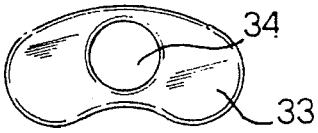
Fig.11
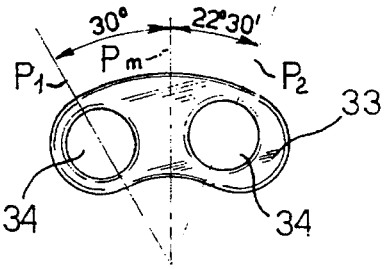

MODULAR SUPPORT ELEMENT ADAPTED TO FORM A SUPPORT FOR A TREAD OF A STAIRCASE

BACKGROUND OF THE INVENTION

The present invention relates to a modular support element adapted to form a support for a corresponding staircase tread and to be connected to contiguous elements to form a staircase.

Staircases are known which comprise a plurality of modular support elements each of which has a plurality of walls of rather complicated shape for forming a support platform for the respective tread and suitable coupling seats for the connection of that element to contiguous ones; such staircases also include a plurality of spacer members, normally of plate shape, each of which is adapted to be inserted between two contiguous modular elements, as well as a plurality of threaded connecting members which are arranged to interconnect the contiguous modular elements with the spacer members interposed between them.

The threaded connecting members include at least one bolt which is adapted to pass through an elongate aperture formed in one wall of each modular element and a hole formed in another wall of the contiguous element; this bolt, which is normally locked by a nut, serves to connect two contiguous elements together.

Modular support elements of the type described and staircases made therefrom have several disadvantages.

First of all, they do not enable the height of the step riser to be adjusted simply and quickly; indeed this height is adjusted by the interposition of a spacer member between two contiguous elements: the operations which are needed for the interposition of this member and for locking together the two elements between which the member has been inserted require particular care and skill. Moreover, in order to satisfy the need for staircases to be constructed with different riser heights, it is necessary to provide a large number of spacer members of different dimensions. Furthermore the tread depths of the various steps may be achieved only to a certain approximation since this depth is determined simply by the sliding of one modular element longitudinally relative to the contiguous element, which movement is allowed by the presence of the aforesaid aperture in one of the walls of each element.

The resistance which each modular element presents to rotation relative to the contiguous element about a vertical axis is thus rather poor; indeed, this resistance depends solely on the frictional torque generated between these elements and this depends on the degree to which the bolt which connects the elements is tightened during assembly and hence the degree to which the bolt is stressed and obviously this cannot reach very high values. As a result, therefore, small rotational movements can occur between one element and the contiguous one even when the staircase has been assembled.

Finally, in order to form staircases whose modular elements are arranged in a predetermined angular configuration relative to each other, long and complicated assembly operations are needed; indeed, in order to place two contiguous elements in a predetermined angular configuration it is necessary to measure the respective angle or to use suitable checking equipment.

SUMMARY OF THE INVENTION

The object of the present invention is to provide a modular support element for forming a support for a tread of a staircase, which is made by connecting together a plurality of the said elements, which does not have the disadvantages described above. In particular, an object of the invention is to provide a modular support element for a staircase which can take up any configuration in space and enables the riser height and tread depth of a step to be varied quickly and rapidly within predetermined limits. Another object of the invention is to provide a modular support element which has a very simple construction and includes only a few parts and which may thus be manufactured at low cost.

These objects are achieved by means of a modular support element for forming a support for a tread of a staircase made by the interconnection of a plurality of the said elements, characterised in that each of the elements comprises at least an upper wall member and a lower wall member which are substantially planar and adapted to take up horizontal positions when the staircase is assembled, the lower and upper wall members of each element being adapted to rest on the upper wall member and lower wall member respectively of a contiguous element; first adjustment and fixing means for enabling the upper wall member to be moved relative to the lower wall member of each element in a direction substantially perpendicular to the wall members themselves and for fixing these wall members together in a predetermined position corresponding to a desired distance between them and hence of a desired value of the height of the riser of the respective step formed with the support element; at least one pair of holes formed in the upper wall member of each element and at least one pair of female threads each of which is coaxial with one of the holes, the female threads being fixed to the upper wall member; at least a through-hole and a through-slot formed in the lower wall member of each element, the through-slot being adapted to be traversed by the threaded shank of a first screw member and the slot being adapted to be traversed by the threaded shank of a second screw member, each of the screw members also passing through one of the holes of the pair of holes formed in the upper wall member of the said element and being adapted to be screwed into the corresponding female thread so as to fix the support element to the contiguous support element.

BRIEF DESCRIPTION OF THE DRAWINGS

In order to provide a better understanding of the structure of the modular support element of the invention and of the staircase obtained therewith, a detailed description of such an element will now be given, by way of example, with reference to the appended drawings, in which:

FIGS. 2 and 3 show, in vertical section and in plan respectively, a lower hollow body which forms part of a support element;

FIG. 7 is a section of part of a modular support element taken in a plane corresponding to the line VII—VII of FIG. 1;

FIGS. 10 and 11 are plan views of two platelets used for the angular positioning of two contiguous modular elements;

DETAILED DESCRIPTION OF THE INVENTION

Figure 14:
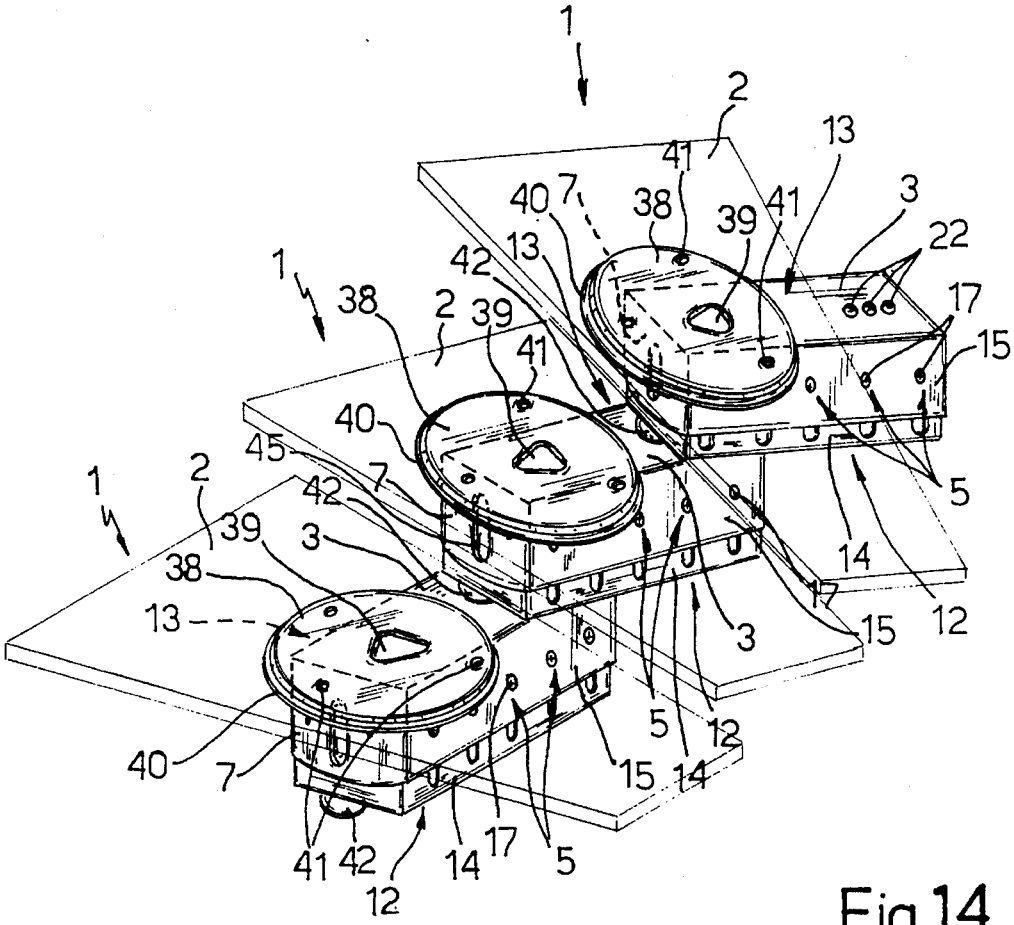
FIG. 14 is a perspective view of several support elements of the invention connected together to form a staircase.

The modular support element of the invention, indicated by numeral 1, is adapted to form a staircase having any spatial configuration, for example of the type shown in FIG. 14 and of which only a part is shown schematically. Each element is adapted to form a support for a tread 2 which is fixed to the respective element in the manner which will be described below.

Figure 1:
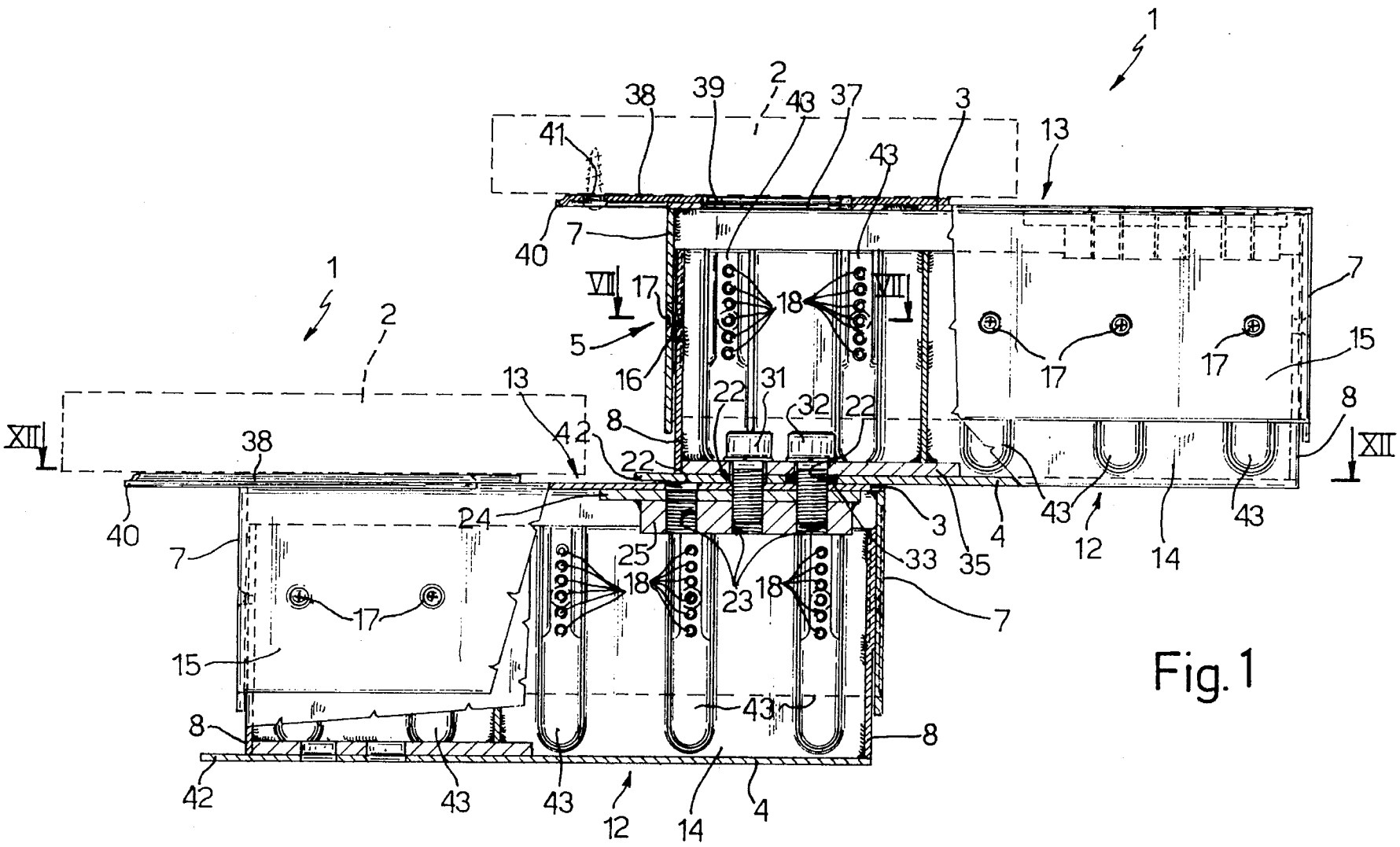
FIG. 1 is a vertical section through a pair of modular support elements of the staircase of the invention in the configuration in which they lie in the erected staircase.

Each element 1, as is clearly seen in FIG. 1, comprises essentially an upper plate 3 and a lower plate 4 which are substantially flat and which are adapted to take up horizontal positions when the staircase is assembled. The lower plate 4 and the upper plate 3 of each element are adapted to bear against the upper plate 3 and the lower plate 4 respectively of the contiguous element, as is clearly seen in FIG. 1.

Each element includes adjustment and fixing means generally indicated at 5 for enabling the upper plate 3 to be displaced relative to the lower plate 4 of each element in a direction substantially perpendicular to the plates themselves; the said means also enable these plates to be fixed together in a predetermined position corresponding to a desired distance between them and hence to a desired height of the riser of the respective step tread 2.

Figure 4:
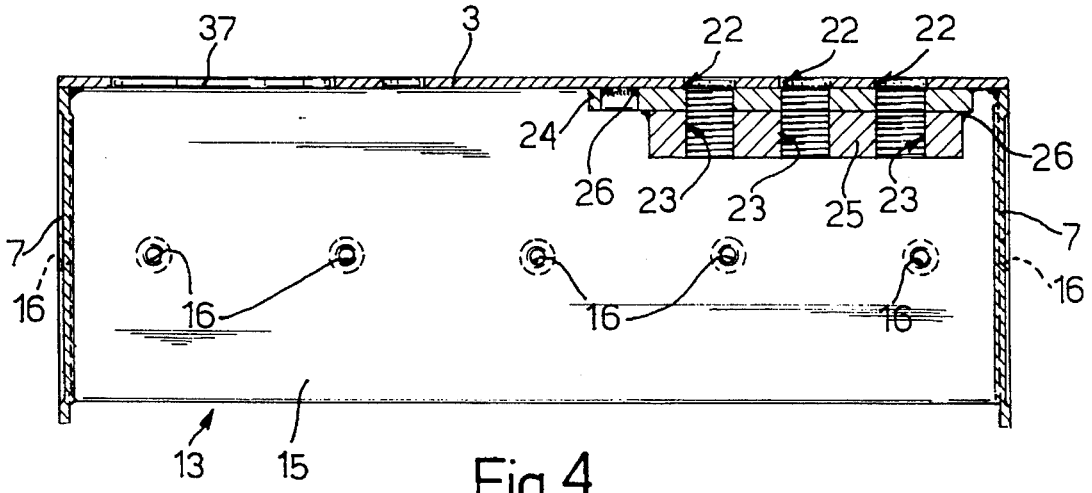
FIGS. 4 and 5 show, in vertical section and in plan respectively, an upper hollow body which forms part of a support element of the staircase.
Figure 5:
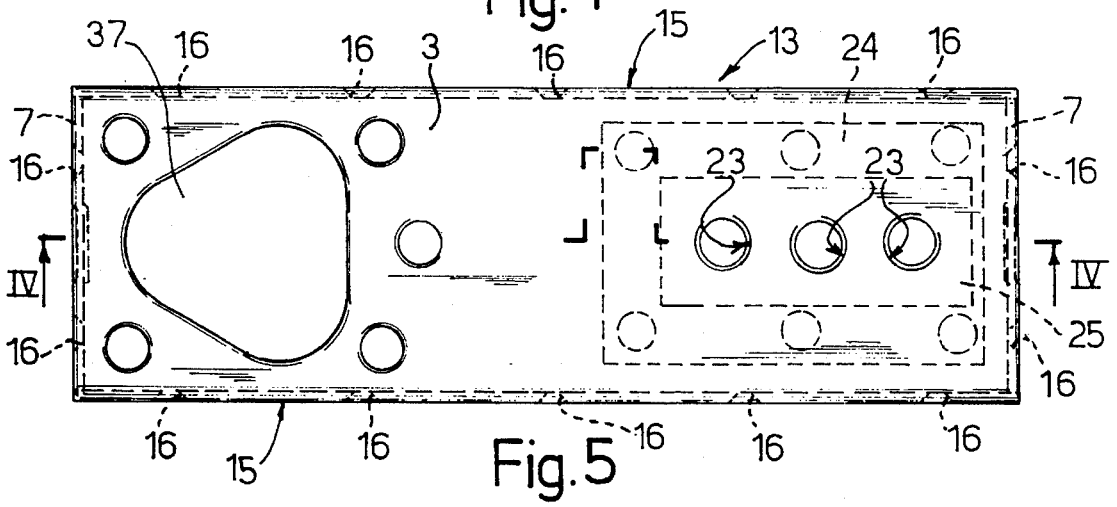

The adjustment and fixing means comprise at least one pair of flat walls 7 fixed to the upper plate 3 perpendicular thereto and at least one second pair of flat walls 8 fixed to the lower plate 4 perpendicular thereto; the adjustment and fixing means 5 moreover also include threaded connecting members for fixing the first pair of flat walls 7 in a predetermined position relative to the second pair 8. Conveniently, each of the support elements 1 includes a lower hollow body 12 (FIGS. 1, 2 and 3) and an upper hollow body 13 (FIGS. 1, 4 and 5) each of which is of substantially parallelepipedal shape; the lower hollow body 12 (FIGS. 2 and 3) is defined by two pairs of flat side walls, one pair of which is constituted by the walls 8 mentioned above and the other by walls 14 perpendicular thereto as well as by the lower plate 4. The upper hollow body 13 (FIGS. 4 and 5) is also defined by two pairs of side walls, one pair of which is constituted by the walls 7 mentioned above and the other by walls 15 perpendicular thereto, as well as by the upper plate 3.

The upper hollow body 13 is adapted to be connected in the manner shown in FIGS. 1 and 7, to the lower body 12 so that the side walls of the upper body bear against the side walls of the lower one. Conveniently the side walls 7 and 15 (FIGS. 4 and 5) of the upper hollow body have holes 16 for traversal by screws 17 (FIG. 7) adapted to be screwed into corresponding threaded holes 18 (FIGS. 7 and 2) in the side walls 8 and 14 of the other hollow body 12.

The upper plate 3 of each support element 1 is formed with at least one pair of holes 22 (FIGS. 4 and 5) (in the embodiment illustrated, there are three holes 22) and at least one pair of female-threads 23 (three in the case of FIGS. 4 and 5) is fixed to this wall, each of the female threads being coaxial with one of the said holes; conveniently these female threads are formed in a pair of platelets 24 and 25 fixed to the wall 3; conveniently the first of these has a greater width and smaller thickness than that of the underlying one and both are connected to the plate 3 by welding at 26.

The lower plate 4 of each element is formed with at least one hole 29 (FIGS. 3 and 7) and a slot 30, both being through-apertures; the said hole is adapted to be traversed by the threaded shank of a first bolt 31 (FIG. 1) and the slot is adapted to be traversed by the threaded shank of a second bolt 32. Each of these bolts also passes through one of the holes 22 of the pair of holes formed in the upper plate 3 of the contiguous element and is screwed into the corresponding female thread 23 so as to clamp one support element to the contiguous support element. The slot 30 is essentially in the shape of a circular sector (FIGS. 3 and 7) centred on the centre of the hole 29 formed in the lower plate 4 so that, when the first bolt 31 is screwed into the corresponding female thread 23 (FIG. 12), the support element can be rotated relative to the contiguous one substantially about the axis of this bolt. Each of the lower hollow bodies 12 includes a plate 35 (FIG. 2) fixed to the upper surface of the lower plate 4; this plate has a hole 29' coaxial with the hole 29 and a slot 30' the axis of which corresponds to that of the slot 30 formed in the lower plate 4. The slot 30' has a similar shape to that of the slot 30 but has smaller dimensions in plan than those of the slot 30, the dimensions being such as to allow solely the shank of the screw 32 to pass through, as will clearly be seen in FIG. 1.

The support element further includes a platelet 33 (FIGS. 10, 1 and 12) having a periphery corresponding to the periphery of the slot 30 and adapted to be inserted in the slot itself; when the platelet 33 is inserted in the slot 30 as is seen in FIG. 1, a portion of the plate 35 overlies the platelet 33 since the slot 30' formed in the plate 33 has smaller dimensions than the slot 30 formed in the plate 4.

Figure 12:
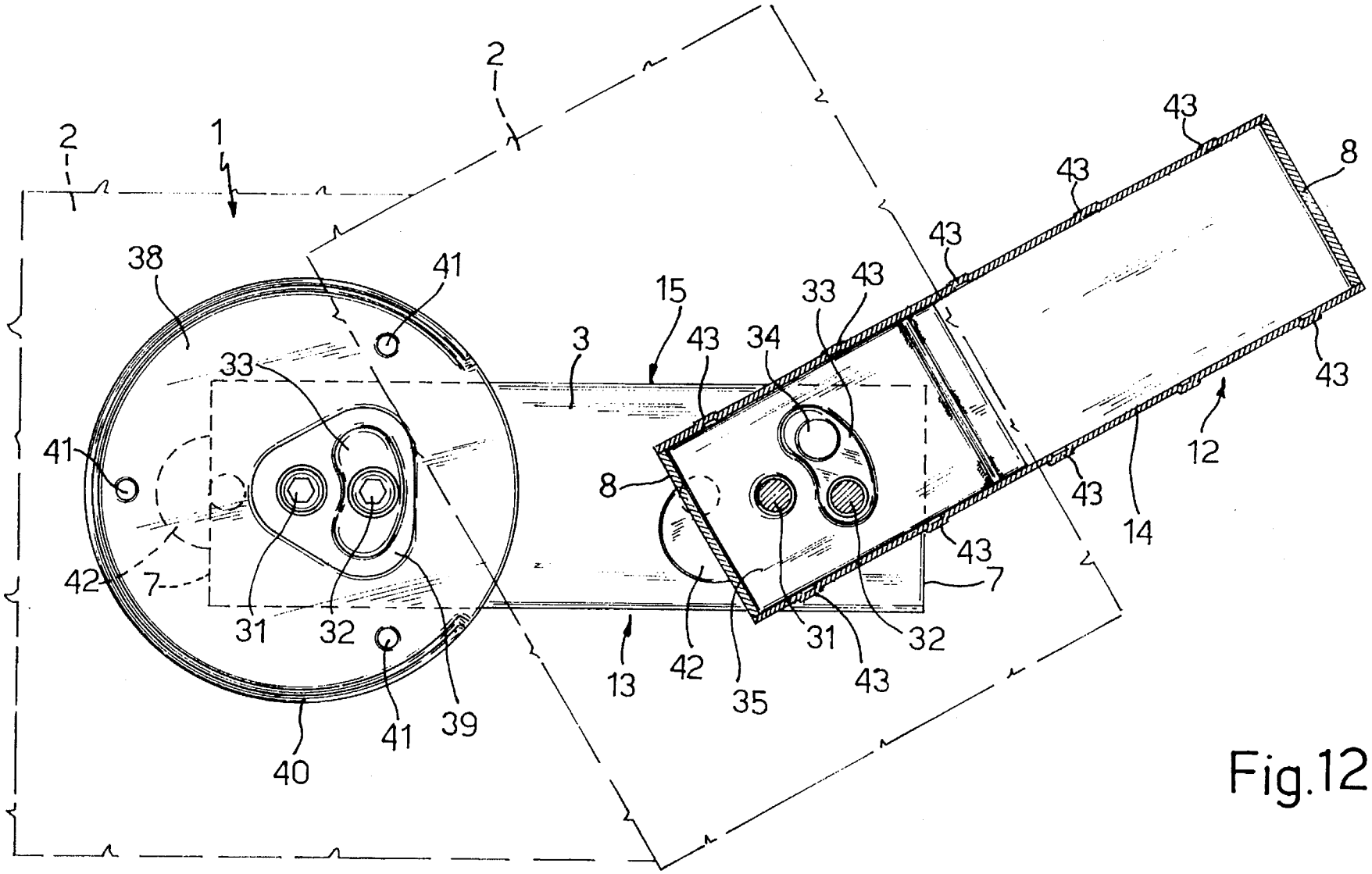
FIG. 12 is a section if a pair of support elements such as those of FIG. 1 taken in a plane corresponding to the line XII—XII of FIG. 1 showing the two support elements of the pair assembled at a predetermined angle to each other.

The platelet 33 has at least one hole 34 (FIG. 10) for traversal by the second bolt 32 (FIG. 12). Conveniently the platelet 33 has a pair of holes 34, as shown in FIG. 11; in this case the angles between the planes (indicated $P_1$ and $P_2$) which contain the axes of these holes and the vertical median plane (indicated $P_M$) of the platelet differ; these angles may be chosen to be 20°30' and 30°.

There are preferably three holes 22 formed in the upper plate 3 (FIGS. 1 and 4), each of these being coaxial with a corresponding thread 23 fixed to the wall itself; with this arrangement, the first and second bolts 31 and 33 respectively may be inserted in a first pair of three holes when the support element is to form a first tread depth with the contiguous element but may, alternatively, be inserted in a second pair of the three holes mentioned above when the support element is to form a second tread depth with the contiguous element.

Figure 8:
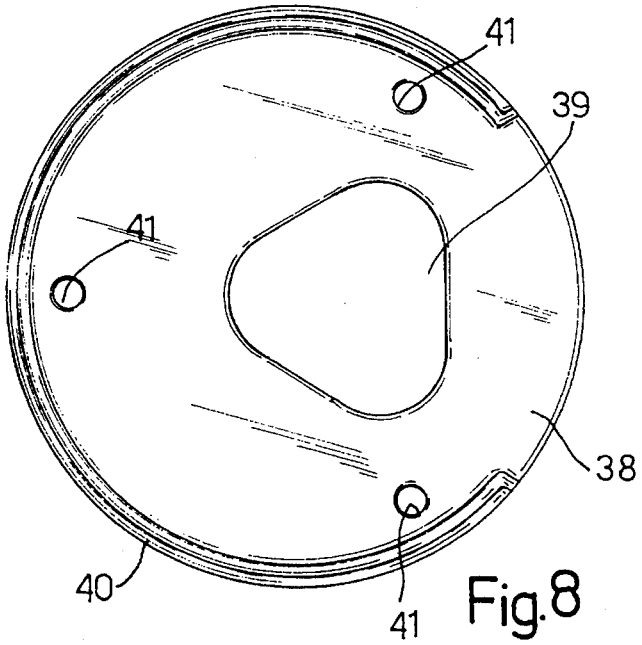
FIGS. 8 and 9 are a plan view and a partial vertical sectional view respectively of a support plate adapted to be connected to the upper hollow body of FIGS. 4 and 5.
Figure 9:
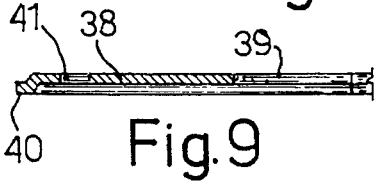

The upper plate 3 of each element is formed with an aperture 37 (FIGS. 1,4 and 5) for the passage of a key for locking the bolts 31 and 32; conveniently this aperture has a substantially triangular shape. Moreover a bearing plate 38 is fixed to the upper surface of the upper plate 3 by, for example, welding (FIG. 8), the bearing plate being disc-shaped and also having an aperture 39 identical to the aperture 37 and superimposed thereon when the bearing plate is fixed to the upper plate; the bearing plate 38 has an annular portion 40 slightly rebated relative to the central part of the plate, as can be seen in the section of FIG. 9; finally, this plate has holes 41 for traversal by screws for fixing the tread 2 (FIG. 1) which bears on the upper surface of the plate itself.

The lower hollow body 12 has a flange 42 (FIG. 2 and 12) of semicircular shape which projects from the front part of the plate 4 of this body.

Conveniently, as can easily be seen from the section of FIG. 7, the threaded holes 18 provided in the walls 8 and 14 of the lower hollow body 12 are formed in wall portions which are so shaped as to form vertical projections 43 the outer surfaces of which serve as guides for the inner surfaces of the walls 7 and 15 of the upper hollow body 13.

Figure 6:
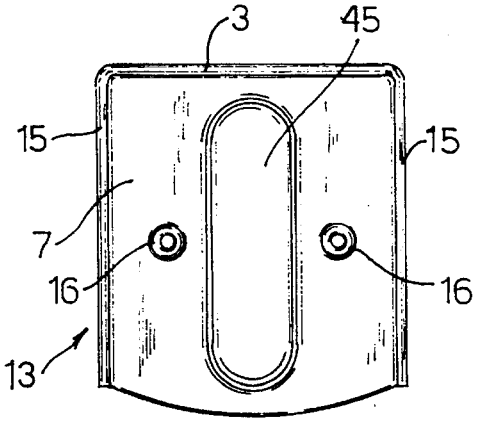
FIG. 6 is a front elevation view of the body of FIGS. 4 and 5.

Moreover, the front wall 7 of the upper hollow body 13 is formed with a recess 45 (FIG. 6) for stiffening the wall itself; in order to stiffen the upper hollow body 12 a further inner vertical wall 44 may be provided (FIGS. 2 and 3).

The support elements which have been described and which are shown in FIG. 1 are adapted to constitute intermediate elements of the staircase. The two end elements thereof (not shown) are substantially the same as those described since the lower one differs only in that it has a base plate adapted to rest on the floor while the upper one has a shorter length (in the direction of the tread) and is provided with attachment means (not shown) for connecting it to the building block to which the staircase is normally fixed.

Figure 13:
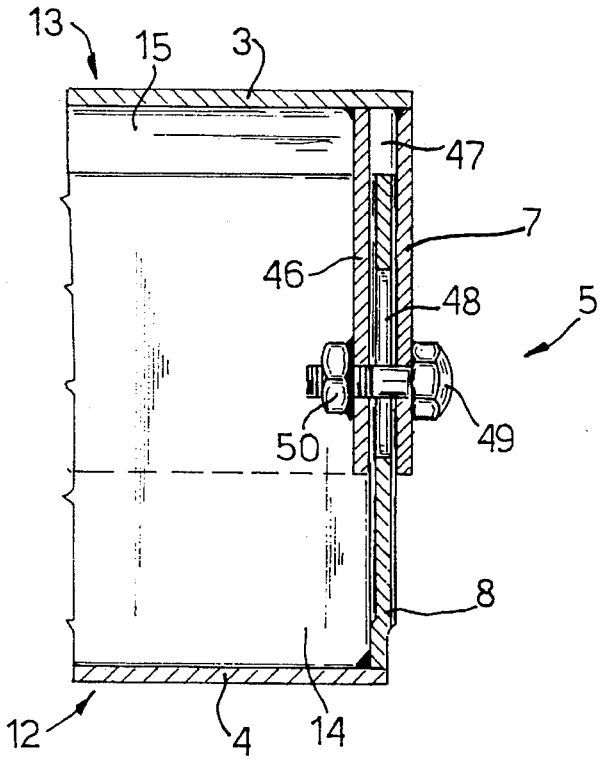
FIG. 13 is a vertical section through part of a different support element from that of the preceding drawings.

In the embodiments shown in FIG. 13, a further pair of flat walls 46 is fixed to the upper element 13, each of these being parallel to the wall 7 and defining therewith a cavity 47 into which the wall 8 of the lower hollow body 12 can be inserted. This wall 8 has a slot 48 and a bolt 49 is arranged to pass through the hole 16 in the wall 7 and through the slot 48 in the wall 8 for screwing into a corresponding threaded hole in a nut 50 fixed to the wall 46.

The use of support elements of the invention to form a staircase is as follows.

First of all, the height of the steps of the staircase is fixed; for this purpose it suffices to vary the distance between the upper plate 3 and the lower plate 4 of each element, the hollow bodies 12 and 13 being displaced relative to each other; during this displacement the projections 43 (FIG. 7) of the lower hollow body 12 form guides for the corresponding walls 7 and 15 of the upper hollow body 13. The two hollow bodies can then be fixed to each other by means of the screws 17. In the embodiment of FIG. 1, the height adjustment is discontinuous and the minimum variation which may be achieved is equal to the distance between the holes 18 (FIG. 2).

In the embodiment of FIG. 13, continuous adjustment is possible due to the presence of the slots 48: the hollow bodies 12 and 13 may in this case be clamped together by the tightening of the bolts 49 which deform the walls 7 and 46 resiliently and clamp the walls 8 within the corresponding cavities 47 by friction.

Subsequently, each support element 1 may be fixed to a contiguous underlying element and locked thereto by means of the screws 31 and 32 (FIG. 1). Before this operation is carried out, the depth of the staircase tread and the angle formed between each element and the underlying one must be determined. In fact, whenever three holes 22 are provided in the upper plate 3 of each support element, as is the case in the embodiment illustrated, it is possible to select one of two tread depths: the larger one is obtained by the insertion of the bolts 31 and 32 in that pair of holes 22 in the upper plate 3 of the lowermost element which is located closer to the rear of the element itself, as shown in FIG. 1. On the other hand, when the other tread depth is to be selected, which is smaller than the previous one, the screws 31 and 32 are be inserted in the other pair of holes. The bolts 31 and 32 are introduced through the aperture 37 in the overlying element and locked by means of a suitable key introduced through the aperture itself.

The angular position of each element relative to the contiguous one is adjusted by the simple rotation of the upper element relative to the lower one about the axis of the first bolt 31: as may be seen from FIG. 12, this rotation is allowed even when the two bolts 31 and 32 have been inserted in their female threads 23 due to the presence of the slot 30 (in which it is supposed that the respective platelet 33 has not yet been inserted). Once this adjustment has been carried out, these screws are locked in their nuts so as to prevent any relative movement between the two support elements. The heads of these bolts bear on the plate 35.

Whenever the angle selected corresponds to one of those provided by one of the platelets 33 (for example an angle of 0° is provided by the platelet of FIG. 10 or angles of 30° or 22°30' by the platelet of FIG. 11), before the bolts 31 and 32 are inserted, the platelet 33 is located in the slot 30 in the plate 4; the bolt 31 is then inserted in the holes 29', 29 and 22 and in the female thread 23. The upper element may then be rotated relative to the lower one about the axis of the bolt 31 to adjust the angular position of the first relative to the second and, when the angle has been adjusted, the bolt 32 is passed through the slot 30' in the plate 35, into a hole 34 in the platelet 33 and into the hole 22 in the plate 3 and, subsequently, this bolt and the bolt 31 are tightened. At the end of this operation, as is seen from FIG. 1, the platelet 33, as well as being locked in the slot 30, is clamped between the plate 4 and the plate 35 since a portion of this plate outside the periphery of the slot 30' is superposed on the platelet 33.

Whenever the larger of the two tread depths is selected, whatever the angular position of the upper element relative to the lower one, the flange 42 covers the hole 22 in the plate 3 (of the lower element) in which no bolt has been inserted, preventing extraneous matter from entering this hole.

Finally, each tread 2 is fixed to its support element, the tread being located on the plate 38 and screws being inserted in the holes 41 thereof and screwed into the material of the tread; since the peripheral edge 40 (FIG. 9) is prevented from contacting the tread by its slight rebate relative to the bearing surface of the plate 38, the tread (normally made of soft material such as wood) is not deformed locally.

It is clear that a staircase may be made from the modular support elements of the invention in which the height of the risers and the tread may be selected within predetermined ranges. Moreover the adjustment of the height is entirely independent of that of the tread depth and the respective operations for varying these parameters may be carried out quickly and simply without mutual influence.

The staircase so obtained is very strong since each pair of contiguous elements is connected by a pair of bolts (the screws 31 and 32) which give the structure obtained considerable flexural and torsional rigidity; moreover the relative angular positioning of two contiguous elements may be adjusted very precisely and this position is maintained even when the staircase is considerably stressed; in fact, whenever the platelet 33 is not used, relative rotation between two contiguous elements is prevented by the high frictional torque generated by the clamping force exerted by the pair of bolts 31 and 32; whenever, however, this plate is used, this prevents any relative rotation between the two contiguous elements whatever the force exerted by the screws 31 and 32.

Finally, the staircase described is structurally very simple and may be produced very cheaply.

It is clear that modifications and variations may be made to the embodiment of the modular element of the invention described both in terms of shape and in the arrangement of the various parts without thereby departing from the scope of the invention.

What is claimed is:

1. A support for treads (2) of a staircase comprising a plurality of interconnected, modular support elements, each of said elements comprising at least an upper wall member (3) and a lower wall member (4) which are substantially planar and adapted to take up horizontal positions when the staircase is assembled, the lower wall member (4) and upper wall member (3) of each element being adapted to rest on the upper wall member (3) and the lower wall member (4) respectively of contiguous elements;

first adjustment and fixing means (5) for enabling the upper wall member (3) to be moved relative to the lower wall member (4) of each element in a direction substantially perpendicular to the wall members themselves and for fixing these wall members together in a predetermined position corresponding to a desired distance between them and hence of a desired value of the height of a riser of a respective step formed by the support element;

at least one pair of holes (22) formed in the upper wall member (3) of each element and at least one pair of female threads (23) each of which is coaxial with one of the holes, the female threads being fixed to the upper wall member (3);

at least one through-hole (29) and one through-slot (30) formed in the lower wall member (4) of each element, first and second screw members (31, 32) having respective threaded shanks, the through-hole (29) being adapted to be traversed by the threaded shank of the first screw member (31) and the through-slot (30) being adapted to be traversed by the threaded shank of the second screw member (32), each of the screw members also passing through one of the holes (22) of the pair of holes formed in the upper wall member (3) of the contiguous said element and being adapted to be screwed into the corresponding female thread (23) of said contiguous element so as to fix each said support element to the contiguous support element.

2. A support according to claim 1, wherein the through-slot (30) in each element is substantially in the shape of a circular sector centered on the center of the through-hole (29) formed in the lower wall member (4) of the same element so that, when the first screw member (31) is screwed into the corresponding female thread (23), the support element can be rotated relative to the contiguous support element substantially about the axis of the first screw member (31).

3. A support according to claim 1, which further includes a plate (35) fixed to the lower wall member (4) of each support element and formed with a hole (29') coaxial with the through-hole (29) in said lower wall member and with a second slot (30') having its axis coincident with that of the through-slot (30) in said lower wall member but being of smaller dimensions than the latter through-slot (30).

4. A support according to claim 3, which further includes a platelet (33) having a periphery corresponding to the periphery of the through-slot (30) and adapted to be inserted in the slot itself and to be covered by a portion of the plate (35) which is outside the periphery of the second slot (30'), the platelet (33) having at least one hole (34) for traversal by the second screw member (32).

5. A support according to claim 4, wherein the platelet (33) has a pair of said holes (34), the angles between the planes containing the said holes having axes which are inclined at different angles with a median vertical plane of the platelet.

6. A support according to claim 5, wherein the angles are 22° 30' and 30° respectively.

7. A support according to claim 1, wherein the upper wall member (3) of each element is formed with three holes (22), each of which is coaxial with the corresponding female thread (23) fixed to the wall itself so that the first screw member (31) and the second screw member (32) may be inserted in a first pair of the three holes when the support element is to form a first tread depth with the contiguous element and may alternatively be inserted in a second pair of the said holes when the support element is to form a second tread depth with the contiguous element.

8. A support according to claim 1, wherein the upper wall member (3) of each of the elements is adapted to constitute a support for a corresponding tread (2).

9. A support according to claim 1, wherein the first adjustment and fixing means (5) includes at least one pair of flat walls (7) fixed to the upper wall member (3) perpendicular thereto and at least one second pair of flat walls (8) fixed to the lower wall member (4) perpendicular thereto, and threaded connecting members for fixing the first pair of flat walls (7) to the second pair of flat walls (8) in a predetermined position.

10. A support according to claim 1, wherein each of the elements (1) includes a lower hollow body (12) and an upper hollow body (13), each of substantially parallelepipedal shape and defined by two pairs of flat side walls and by the flat lower wall member (4) and by the flat upper wall member (3) respectively, the upper hollow body (13) being adapted to be connected to the lower hollow body (12) so that the side walls of the upper body (3) bear against the side walls of the lower body, some of the side walls of the upper hollow body (13) having holes (16) arranged to be traversed by screws (17) adapted to screw into corresponding threaded holes (18) in some of the side walls of the lower hollow body (12).

11. A support according to claim 10, wherein the holes (18) are formed in vertical projections (43) on the side walls (8,14) of the lower hollow body (12) which project outwardly of the body itself.

12. A support according to claim 10, wherein each of the hollow upper bodies (13) includes a pair of platelets (24,25) fixed to the lower surface of the upper wall member (3) of the element and having threaded holes for forming the said female threads (23).

13. A support according to claim 10, wherein each of the lower hollow bodies (12) includes a further platelet (35) fixed to the upper surface of the lower wall member (4) of the element, the further platelet having a hole (29') and a slot (30') corresponding to the through-hole (29) and the through-slot (30) in the lower wall (4), the further platelet (35) being adapted to constitute an abutment for heads of the first screw member (31) and the second screw member (32).

14. A support according to claim 10, wherein one of the side walls (7) which defines the front of each lower hollow body (12) has a projecting flange (42) for covering one of the holes (22) formed in the upper wall member (3) of the element.

15. A support according to claim 1, wherein the upper wall member (3) of each element is formed with a through-aperture (37) for the passage of a key for locking the screw members (31, 32), the aperture having a substantially triangular shape.

16. A support according to claim 1, which further includes a disc-shaped plate (38) fixed to the upper wall member (3) of each element and adapted to constitute a support for a corresponding tread (2), the plate having holes (41) for the passage of screws for fixing the tread thereto.

* * * * *